US005921432A

United States Patent [19]

Van Berne et al.

[11] Patent Number: 5,921,432

[45] Date of Patent: Jul. 13, 1999

[54] COVER FOR A CONTAINER WITH BENT TOP EDGE

[75] Inventors: Joost Van Berne, Breda; Christiaan J.M. Moorman, Veghel, both of Netherlands

[73] Assignee: DSM N.V., Heerlen, Netherlands

[21] Appl. No.: 08/898,438

[22] Filed: Jul. 22, 1997

[30] Foreign Application Priority Data

Aug. 30, 1996 [NL] Netherlands ..... 1003918

[51] Int. Cl.[6] ..... B65D 39/00

[52] U.S. Cl. ..... 220/792; 220/795; 215/43; 215/320; 215/321

[58] Field of Search ..... 220/780, 792, 220/795; 215/42, 43, 45, 317, 320, 321

[56] References Cited

U.S. PATENT DOCUMENTS

| | | | |
|---|---|---|---|
| 2,765,831 | 10/1956 | Tupper | 220/792 |
| 2,789,608 | 4/1957 | Tupper | 220/792 |
| 2,816,589 | 12/1957 | Tupper | 220/792 X |
| 2,859,786 | 11/1958 | Tupper | 220/792 |
| 3,487,972 | 1/1970 | Swett | 220/780 X |
| 4,094,460 | 6/1978 | Scanga et al. | 215/350 X |
| 4,410,479 | 10/1983 | Cyriax . | |
| 4,552,384 | 11/1985 | Cyriax . | |
| 4,743,422 | 5/1988 | Kalriis-Nielsen . | |
| 4,791,034 | 12/1988 | Dopp . | |

FOREIGN PATENT DOCUMENTS

| | | |
|---|---|---|
| 28 45 308 | 4/1980 | European Pat. Off. . |
| 188 301 | 7/1986 | European Pat. Off. . |
| 279 348 | 8/1988 | European Pat. Off. . |
| 2 258 316 | 8/1975 | France . |
| 2 305 366 | 10/1976 | France . |
| 162555 | 6/1980 | Netherlands . |

*Primary Examiner*—Stephen K. Cronin
*Attorney, Agent, or Firm*—Pillsbury Madison & Sutro LLP

[57] ABSTRACT

Cover for sealing a container which is bounded at the top side by an outward bent top edge, said cover being provided along the periphery with a downward opening groove which encloses the top edge and is bounded by an outside wall, an inside wall, and a top wall connecting said walls, in which the width of the groove at the position of the top wall is less than the deflection of the top edge of the container, and the surface of the groove walls which adjoins the groove is made of a layer of elastic material.

15 Claims, 1 Drawing Sheet

COVER FOR A CONTAINER WITH BENT TOP EDGE

BACKGROUND OF THE INVENTION

1. Field of the Invention

The invention relates to a cover for sealing a container which is bounded at the top side by an outward bent top edge, said cover being provided along the periphery with a downward opening groove which encloses the top edge and is bounded by an outside wall, an inside wall, and a top wall connecting said walls.

2. Description of the Related Art

Such a cover is known from Patent Specification No. NL 162555. In this cover the entire inner surface of the groove walls is in contact with the outward bent top edge when the container is closed.

A disadvantage of this known construction is that considerable friction must be overcome for opening and closing of the cover, and that the material of groove and edge is exposed to considerable deformations, with the result that, after opening and closing a certain number of times, these parts can lose their shape and resilience, so that the sealing action is lost. On the other hand, an outward bent top edge is advantageous for a good sealing effect.

SUMMARY OF THE INVENTION

The object of the invention is to provide a cover in which the abovementioned disadvantage is eliminated or is found to a substantially lesser extent, but which cover does guarantee a good seal.

This object is achieved according to the invention through the fact that the width of the groove at the position of the top wall is less than the deflection of the top edge of the container, and that the surface of the groove walls which adjoins the groove is covered with a layer of elastic material which is firmly connected to said surface.

When the container is closed, the cover according to the invention, as a result of the above-mentioned features, seals the container along two continuous lines running along the entire periphery of the top edge, one of the lines being situated along the outer periphery of the edge, and the other along the inner periphery. If forces are now exerted on the edge of the cover in a direction which would lead to the seal along one of the two abovementioned lines becoming looser, said force will in general contribute towards the other actually being pressed down more forcefully. The cover consequently continues to seal the container, even if forces are exerted on the cover, and the sealing effect remains largely unaffected when cover and container are deformed. This effect is significantly reinforced through the fact that the insides of the walls of the groove are made of an elastic material, and consequently the forces arising through the fact that the groove is narrower than the deflection of the top edge of the container to some extent produce a certain compression of the elastic material and an improved seal. Due to the fact that the inner surface of the groove is in contact with the top edge only along two peripheral lines or, through the compression of the elastic material, along narrow bands, the friction occurring when the cover is being put on or removed is also considerably lower than that occurring in the case of the known cover, partly as a result of the deformability of the elastic material.

What is meant by the deflection of the top edge of the container is the distance between the continuation of the inside of the container wall directly below the bend where the outside edge begins and the tangent line parallel to said continuation at the outermost point of the outward bent top edge. The deflection depends on the angle through which the top edge is bent relative to the container wall and the length of the top edge. The angle through which the top edge is bent preferably is between 5 and 15°, and more preferably between 8 and 11°. Larger angles make it more difficult to put on the cover, while in the case of smaller angles the force which the groove can exert upon the edge is too low to guarantee a good seal.

The groove consists essentially of an outside wall, an inside wall and a connecting top wall, the inner surface of which is made of a layer of elastic material. The width of the groove at the position of the top wall, in particular where the outermost point of the top edge of the container is resting against the inside of the outside wall of the groove when the cover is closed, is less than the deflection of the top edge. The difference must great enough that, even with the maximum dimensional variations occurring in the production of container and cover, the width of the groove is smaller at the abovementioned portion than the deflection of the top edge. A difference of at least 0.15 mm is suitable, and the difference is preferably at least 0.2 mm. The width of the groove at the abovementioned portion is preferably at least the wall thickness of the top wall plus 0.15 mm.

The width of the groove at the bottom, i.e. in the vicinity of the open end of the groove, is preferably less than it is at the top, i.e. at the position of the top wall, but is at least equal to the wall thickness of the top wall plus 0.15 mm. As a result, the cover is constantly forced towards the closed position when it has come slightly out of that position, so that the cover is prevented from sliding spontaneously off the container. The width preferably runs uniformly from top to bottom, and this is achieved more preferably through the fact that the inside of the outside wall of the groove runs inwards, viewed from the top towards the bottom. It has been found that the user of a container which is sealed with a cover according to the invention during opening thereof clearly feels the cover coming off the container at the moment when the bend between wall and top edge of the container comes out of the groove. The user will then automatically reduce the force which he or she is exerting on the cover. If the cover comes off the container unexpectedly, there is a very great risk of uncontrolled and accidental escape of the contents from the container. As the cover is closed, the user also feels when the cover has reached its sealing position.

The inside wall is preferably of uniform thickness over its full length, apart from possible rounded parts at the end of the wall, and preferably runs in a direction at right angles to the cover face. However, a variation of the order of 0.3–10 for easier unmoulding during the manufacture is acceptable. Greater variations make the opening and closing more difficult. The angle formed by the direction of the inside of the outside wall with the direction of the inside of the inside wall preferably is between 2 and 7°, and more preferably is between 3 and 6°. The range of 4–5° is most preferable. The same preferences apply to the angle between the direction of the inside of the outside wall and the angle through which the top edge of the container is bent. It is also possible to design the construction described above mutatis mutandis in a mirror image, in which case the top edge of the container is bent inwards and then, for example, the inside of the inside wall of the groove runs inwards.

The length of the bent top edge is selected in such a way in relation to the depth of the groove that the bend point situated on the inside of the container is preferably at least 0.2 mm and at most 2.5 mm, and more preferably at least 0.4 and at most 1.6 mm, above the bottom end of the inside of the inside wall when the cover is placed on the container in a sealing manner. The wall of the container also preferably has directly below this inner bend point a part which runs vertically or, as indicated above, virtually vertically at a slight angle which is necessary for easier unmoulding. The inner peripheral line consequently becomes a band whose width lies between the limits indicated above. If the bend point is situated closer to the bottom end of said inside, the corresponding sealing peripheral line lies too close to said end, with the result that when only a slight deformation occurs or when the cover is not pressed down fully during closing, there is a risk of the seal failing. A greater distance than the upper limit indicated, in combination with the length of said vertical part, produces undesirably great friction during the opening and closing.

On account of, for example, use or aesthetic considerations, the wall below can run in a different position or direction. The length of such a vertical part is preferably at least 0.2 mm, and more preferably at least 0.4 mm, and can extend in the vertical direction to the bottom if desired.

The dimensions and angles specified in this application are related to the height of the top edge of the container or, corresponding thereto, the depth of the groove in the cover. The above figures apply for a groove depth of 4 to 7 mm. At greater depths it is permissible in particular to have a smaller angle of the top edge relative to the vertical part of the container wall. However, it is always essential to meet the abovementioned requirement that the difference in the width of the groove and the variation of the top edge of the container must be at least 0.15 mm at the dimensional variations determined by the production process.

The cover can be made of the synthetic materials commonly used for this purpose, polyethylene, polypropylene and polyvinyl chloride being known examples. The elastic material can be selected from the known elastic materials, for example elastomeric materials and preferably thermoplastic elastomers. An elastic material suitable for application in the invention should apart from being flexible also be compressible. The elastic material preferably has a compression set, measured at 100° according to ASTM standard D395, of 20–100% and an application range of −30 to 140°. The elastic material is preferably compatible with the material from which the remainder of the cover is made, as regards the usual manufacturing techniques. In particular, the elastic material and the remaining material of the cover can be processed by injection moulding, and the cover is manufactured by a process known to one skilled in the art as two-component injection moulding. This ensures that the elastic material is integral with the material of the groove situated further outwards. The elastic material and the cover material can also be firmly connected to one another by other methods e.g. gluing or melting. The advantage of this is that the elastic material will not come out of the groove when the cover is in use, a risk which does exist when the elastic material lies in the groove as a loose inner ring. The thickness of the layer of elastic material lies between 0.5 and 3 mm, and is preferably between 0.8 and 2 mm. Suitable combinations of elastic material and remaining material are, for example, polyethylene and a thermoplastic elastomer containing a polyolefin, preferably polyethylene or polypropylene.

The layer of elastic material preferably does not stop at the open end of the groove, but extends beyond the groove until past the end of the outside wall, and in particular to the underside thereof. In this way, the edge of the cover which is gripped during opening is covered with the elastic material, which gives the cover a good grip for the fingers during opening. The outside wall of the groove can be extended in the horizontal direction at one or more corner points to form a lip, the underside of which is then also covered with the elastic material. The elastic material extending beyond the end of the outside wall preferably has a flank running from the underside thereof inwards and upwards and connecting at an angle to the inside of the outside wall, which flank guides the top edge of the container into the groove.

Further advantages of the cover according to the invention are reduced susceptibility to and risk of damage ("burrs") on the top edge of the container and less force applied to the edge of the container by the cover on deformation thereof. Moreover, even at low temperatures, the cover remains more readily deformable for opening, without great force being exerted, which is advantageous because food containers, for which the cover according to the invention is eminently suitable, are generally stored in a refrigerator or freezer. Furthermore, the advantages of the cover according to the invention can be achieved virtually regardless of the peripheral shape or size of the cover, so that the cover is suitable for containers of a wide variety of shapes and sizes. Finally, it is found that the selected groove construction permits relatively large dimensional differences without the quality of the seal and the ease of putting on and removing the cover being adversely affected, which significantly simplifies the production and assembly process, because greater tolerances can be permitted therein than in such processes for the known cover.

BRIEF DESCRIPTION OF THE INVENTION

The invention will be explained with reference to the following drawing, in which.

DETAILED DESCRIPTION OF THE INVENTION

Figure 1:
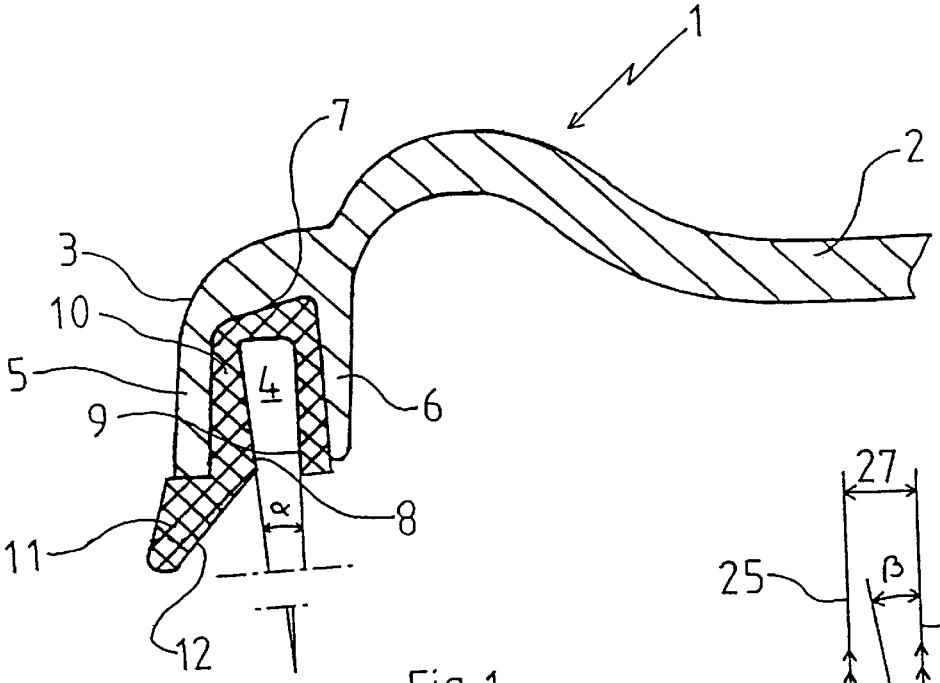
FIG. 1 is part of a vertical section of an embodiment of a cover according to the invention.

FIG. 1 shows a cover 1 with cover face 2 and edge part 3, in which a downward opening groove 4 is present, with outside wall 5, inside wall 6 and connecting top wall 7. The inner surface of the groove 4, which comprises, inter alia, the insides 8 and 9 of outside wall 5 and inside wall 6 respectively, is covered with an elastic material 10. The elastic material extends beyond and below the end of the outside wall 5 and there forms an outside edge 11 with sloping flank 12. The inside 9 of inside wall 6 runs at an angle of 0.5° (release angle) to the vertical, while inside 8 of outside wall 5 runs at an angle $\alpha$, in this embodiment 4°, to the direction of inside 9.

Figure 2:
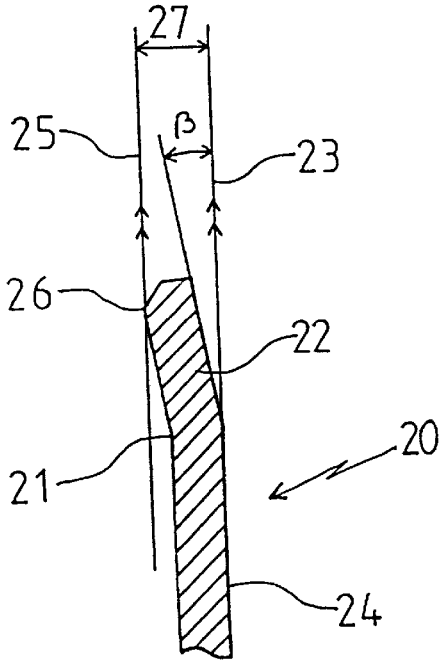
FIG. 2 is part of a vertical section of a container with outward bent top edge.

FIG. 2 shows a container wall 20 which at the bend 21 passes into the outward bent top edge 22. Said top edge is truncated at the top outside. Line 23 is the continuation of inside 24 of container wall 20, while line 25 is the line parallel to 24 through the outermost point 26 of top edge 22. The distance 27 between the lines 23 and 25 is the deflection of the top edge. $\beta$ indicates the angle caused by the deflection, in this embodiment 9°.

Figure 3:
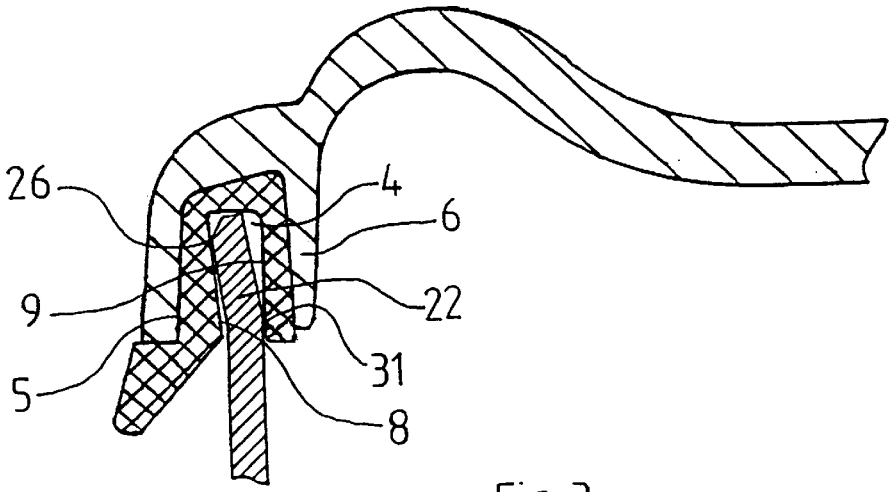
FIG. 3 is part of a vertical section of a container with the cover of FIG. 1 thereon.

In FIG. 3 the container wall from FIG. 2 is shown with its top edge 22 in the groove 4 of the cover according to FIG.

1. The top edge 22 with its outermost point 26 is in contact with the inside 8 of outside wall 5 of the groove 4 and with the inside 9 of inside wall 6 of said groove at the position of the vertical part 31 connecting to the innermost point of bend 21 from FIG. 2. Point 26 and vertical part 31 each form part of a continuous line or band running around the entire periphery of the container and sealing the container.

We claim:

1. Cover for sealing a container which is bounded at a top side by an outward bent top edge, said cover being provided about a periphery thereof with a downward opening groove, an inner surface of the groove being defined by a layer of elastic material which is firmly connected to a remainder of said cover, said downwardly open groove receiving the top edge to seal the container, said groove being thus defined by an outside wall, an inside wall, and a top wall connecting said outside and inside walls, a width of the groove adjacent the top wall being greater than a transverse thickness of said bent top edge and less than a deflection of the top edge of the container from a side wall of the container.

2. Cover according to claim 1, in which the elastic material is also present at an underside of the outside wall of the groove.

3. Cover according to one of claims 1–2, manufactured by a two-component injection moulding process.

4. Cover according to claim 3, in which the width of the groove increases uniformly from the open bottom end of the groove towards the opposite, top end.

5. Cover according to claim 4, in which the inside of the outside wall of the groove runs inwards, viewed from the top end towards the bottom end.

6. Cover according to claim 5, in which the angle between the inside of the outside wall and the inside of the inside wall lies in the range from 3 to 6° inclusive.

7. Cover according to claim 6, in which the angle lies in the range from 4 to 5° inclusive.

8. A covered container comprising, in combination, a container and a cover selectively secured thereto, said container having a bottom wall and peripheral side wall projecting therefrom so as to define at least one product receiving compartment, said side wall having a bent top edge portion which is inclined with respect to a plane of a remainder of said side wall;

said cover having an end wall and a depending peripheral skirt having a downwardly opening recess, said recess being bounded by an outside wall, an inside wall and a top wall connecting said inside and outside walls, at least inner surfaces of said recess being covered with a layer of elastic material which is firmly connected to said surfaces to define a downwardly opening groove, a width of the groove adjacent a top wall thereof, being greater than a transverse thickness of said bent top edge and less than a deflection of the top edge portion of the container side wall.

9. A covered container in claim 8, wherein said top edge portion is bent outwardly relative to said compartment.

10. A covered container according to claim 8, wherein said cover is formed by two-component injection molding an elastic material and a material of said end wall and depending skirt.

11. A covered container according to claim 10, wherein the width of the groove increases uniformly from an open bottom end of the groove towards a top end thereof.

12. A covered container according to claim 11, wherein an inner surface of the outside wall of the groove is inclined inwardly from the top towards the bottom end.

13. A covered container according to claim 8, wherein elastic material is further disposed on an under side of the outside wall of the recess.

14. Cover according to claim 13, in which the angle lies in the range from 4 to 5° inclusive.

15. Cover according to claim 13, in which the angle between the inside of the outside wall and the inside of the inside wall lies in the range from 3 to 6° inclusive.

* * * * *